United States Patent [19]

Hwang et al.

[11] Patent Number: 4,585,677

[45] Date of Patent: Apr. 29, 1986

[54] ARTIFICIAL PLANT

[75] Inventors: Herbert Hwang, Taipei, Taiwan; Henry Weitz, Prosperity House, 11th Floor, 8A-10 Granville Rd., Kowloon, Hong Kong

[73] Assignee: Henry Weitz, Kowloon, Hong Kong

[21] Appl. No.: 753,957

[22] Filed: Jul. 11, 1985

[51] Int. Cl.[4] ..... A41G 1/00

[52] U.S. Cl. ..... 428/26; 156/61

[58] Field of Search ..... 24/5, 6; 156/61; 362/122; 428/24, 25, 26

[56] References Cited

U.S. PATENT DOCUMENTS 3,137,610 6/1964 Flynn ..... 428/26

3,711,696 1/1973 Sieloff ..... 428/24 X

*Primary Examiner*—Henry F. Epstein

*Attorney, Agent, or Firm*—Alvin Sinderbrand

[57] ABSTRACT

An artificial representation or simulation of a plant having stalks or stems in a cluster radiating upwardly from a common point at the apex of a main stem, for example, as in an umbel, is composed of a plurality of stem-defining members each molded of plastic to have respective co-planar stem portions arising from a collar which is engageable on the apex portion of the main stem, and at least one of the stem-defining members has a configuration to position and maintain the respective stem portions in a plane angularly displaced from the plane of the stem portions of each other stem-defining member. Preferably, at least one of the stem-defining members has at least one bifurcated or tined projection extending outwardly from its collar to embrace a stem portion of another of the stem-defining members when the collars are arranged one above the other on the main stem.

4 Claims, 4 Drawing Figures

ARTIFICIAL PLANT

BACKGROUND OF THE INVENTION

1. Field of the Invention

This invention relates generally to artificial plants and, more particularly, is directed to improvements in artificial representations or simulations of plants of the type having stalks or stems in a cluster radiating upwardly from a common point at the apex of a main stem, for example, as in an umbel.

2. Description of the Prior Art

It is known to provide an artificial plant by assembling together numerous stem-defining members molded of plastic and each having suitably configured, radiating stem portions terminating in receptacles adapted to receive separately formed flower or leaf-simulating elements. For the sake of convenience and economy in molding the stem-defining members, it is desirable to form the stem portions thereof in a common plane. Since a natural or live plant does not usually grow with its stems disposed in a common plane, it is desirable, in assembling an artificial plant from a number of the mentioned stem-defining members molded of plastic, to arrange such stem-defining members with their stem portions angularly spaced from each other. Thus, for example, if each of the stem-defining members includes a collar and a plurality of stem portions arising from the collar in a common plane and the collars of the stem-defining members are disposed one above the other on an apex portion of a main stem, it is desirable to position the stem portions of one of the stem-defining members in a plane angularly displaced from the plane of the stem portions of each other stem-defining member. However, in the existing artificial plants of the described character, no provision is made for establishing or maintaining a desired angular displacement of the plane of the stem portions of one stem-defining member relative to the plane of the stem portions of another stem-defining member. Therefore, with time, all of the stem portions may assume positions more or less in a common plane and thereby detract from the natural appearance of the artificial plant.

OBJECTS AND SUMMARY OF THE INVENTION

Accordingly, it is an object of this invention to provide an artificial plant of natural or life-like appearance which can be easily assembled, at least in part, from molded plastic stem-defining members.

More specifically, it is an object of this invention to facilitate the assembling together of an artificial plant from a plurality of stem-defining members which may be each conveniently and economically molded of plastic with the stem portions thereof in a common plane, and wherein the assembled together stem-defining members are reliably disposed and maintained with the plane of the stem portions of one stem-defining member angularly displaced from the plane of the stem portions of another stem-defining member for enhancing the natural or life-like appearance of the artificial plant.

In accordance with an aspect of this invention, an artificial representation of a plant comprising a main stem having an apex portion at an end thereof, and a plurality of stem-defining members each including a collar and a plurality of stem portions arising from such collar, has at least one of the stem-defining members further provided with means operative, when the collars of the stem-defining members are disposed one above the other on the apex portion of the main stem, to hold the stem-defining members against turning relative to each other about the apex portion of the main stem.

In a preferred embodiment of the invention, the means to hold the stem-defining members against turning relative to each other includes at least one, and preferably two bifurcated projections extending from the collar of one of the stem-defining members and each embracing a stem portion of another of the stem-defining members when the collars are disposed one above the other on the apex portion of the main stem.

The above, and other objects, features and advantages of the invention, will be apparent in the following detailed description of an illustrative embodiment thereof which is to be read in connection with the accompanying drawings.

DESCRIPTION OF A PREFERRED EMBODIMENT

Figure 1:
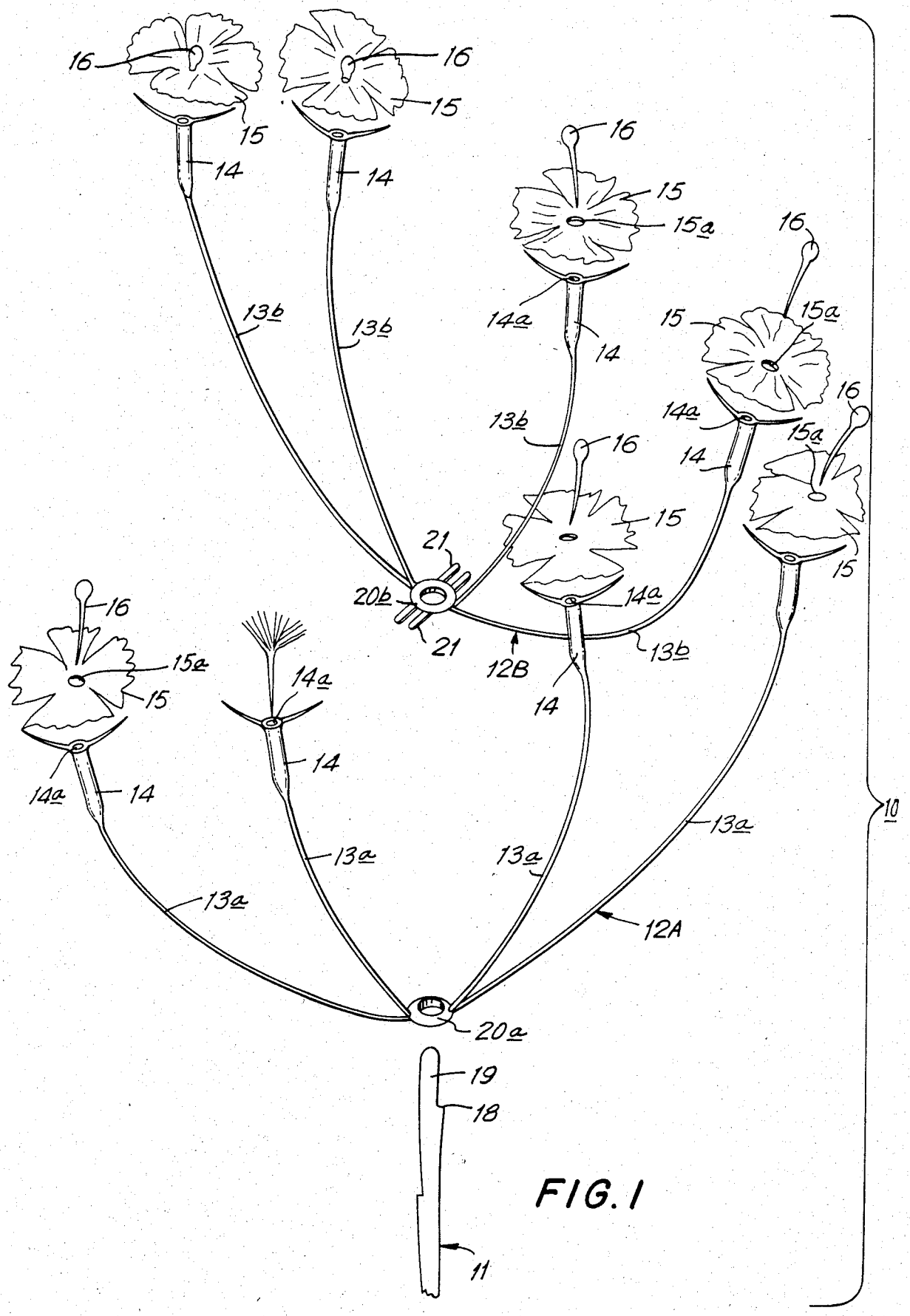
FIG. 1 is an exploded perspective view of various component parts that may be assembled together to provide an artificial plant according to an embodiment of the present invention.

Referring to the drawings in detail, and initially to FIG. 1 thereof, it will be seen that an artificial plant 10 according to one embodiment of the present invention generally comprises a main stem 11, a plurality of stem-defining members 12A and 12B having suitably configured, radiating stem portions **13*a* and 13*b*, respectively, terminating in receptacles 14, and elements 15 and 16 or 17 representing floral organs and being engageable in receptacles 14**.

The main stem 11 is suitably molded of a plastic resin and is desirably formed with a lateral projection 18 adjacent its upper end for defining an apex portion 19 thereabove. The stem-defining members 12A and 12B are also desirably molded of plastic resin and are shown to have collars **20*a* and 20*b*, respectively, from which the respective stem portions 13*a* and 13*b* radiate or branch upwardly and outwardly. In order to minimize the size and complexity of the dies required for molding of the stem-defining members 12A and 12B, each of the stem-defining members 12A and 12B preferably has its stem portions 13*a* and 13*b*** arranged substantially in a common plane.

The collars **20*a* and 20*b* are diametrically dimensioned to engage tightly or frictionally on apex portion 19 of main stem 11 when such collars are disposed one above the other on apex portion 19 during the assembling of stem-defining members 12A and 12B on main stem 11**.

The elements 15 representing floral organs are desirably formed of fabric for simulating petals and each have a central hole **15*a* through which the respective element 16 in the form of a plastic headed pin simulating a pistil is insertable into a bore 14***a* opening at the top of the respective receptacle 14. Each element 17 representing a floral organ may be in the form of a plastic pin insertable into the bore 14*a* of the selected receptacle 14 for simulating a partially open flower bud.

In assembling an artificial plant from the previously described parts, selected elements 15 and 16 or 17 representing floral organs are engaged with the several receptacles 14 of stem-defining members 12A and 12B, and collars 20*a* and 20*b* of such stem-defining members are installed one above the other on apex portion 19 of main stem 11. Since a natural or live plant does not usually grow with its stems disposed in a common plane, it is desirable, in assembling an artificial plant from the stem-defining members 12A and 12B, to arrange such the latter with their respective stem portions 13*a* and 13*b* angularly spaced from each other. Thus, for example, in the case where the stem-defining members 12A and 12B each have their respective stem portions 13*a* or 13*b* arising from the collar 20*a* or 20*b* substantially in a common plane, it is desirable to position and maintain the stem portions 13*a* of stem-defining member 12A substantially in a plane that is angularly displaced from the plane substantially containing the stem portions 13*b* of stem-defining member 12B, as shown on FIG. 4.

Figure 2:
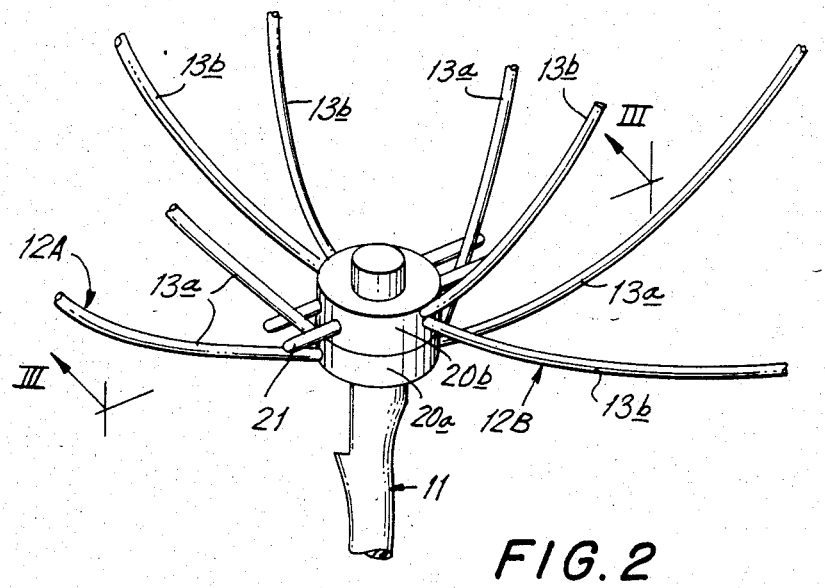
FIG. 2 is a fragmentary perspective view, on an enlarged scale, illustrating several of the parts of FIG. 1 in the assembled condition.
Figure 3:
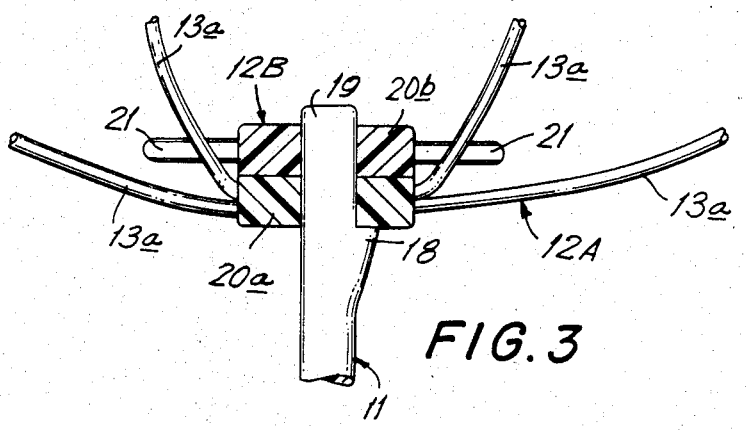
FIG. 3 is a fragmentary, further enlarged sectional view taken along the line III—III on FIG. 2.
Figure 4:
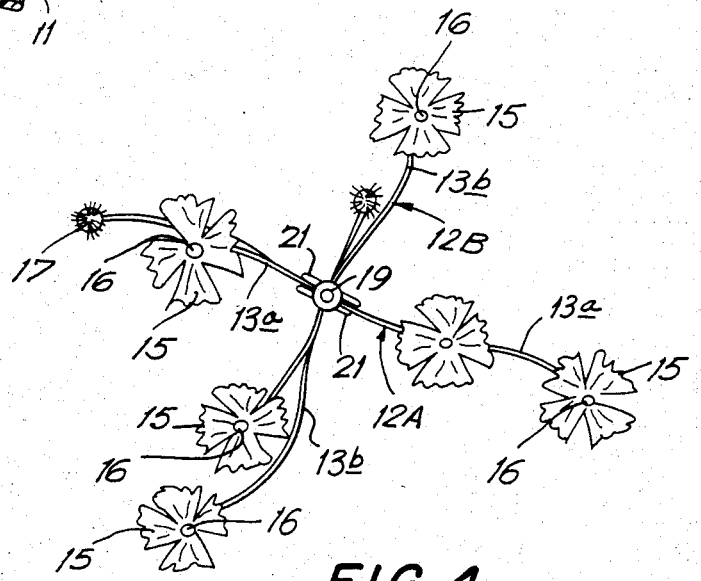
FIG. 4 is a top view, on a reduced scale, of an artificial plant structure representing an umbel and which is assembled from the parts shown on FIG. 1 in accordance with this invention.

Therefore, in the artificial plant 10 according to an embodiment of this invention, at least one of the stem-defining members 12A and 12B is further provided with means operative, when the collars 20*a* and 20*b* of the stem-defining members are disposed one above the other on apex portion 19 of main stem 11, to hold the stem-defining members 12A and 12B against turning relative to each other about apex portion 19 in the relative positions shown on FIG. 4. More particularly, in the illustrated preferred embodiment of the invention, such means for preventing relative turning of stem-defining members 12A and 12B is shown to be constituted by bifurcated projections 21 extending in opposed directions from collar 20*b* of stem-defining member 12B. The bifurcated projections 21 are shown to extend substantially at right angles to the plane of stem-portions 13*b* so that, when collar 20*b* is disposed above collar 20*a* on apex portion 19 of main stem 11 with the plane of stem portions 13*b* substantially at right angles to the plane of stem portions 13*a*, bifurcated projections 21 of member 12B will embrace stem portions 13*a* of the other stem-defining member 12A, as shown on FIGS. 2 and 3. It will be appreciated that, upon such engagement of bifurcated projections 21 with stem portions 13*a* in the course of the assembling of collars 20*a* and 20*b* on main stem 11, stem-defining members 12A and 12B will be thereby conveniently maintained in relative positions in which stem portions 13*a* are angularly displaced from stem portions 13*b*. The resulting array of stem portions 13*a* and 13*b* will desirably simulate a plant of the type having stalks or stems in a cluster radiating upwardly from a common point at the apex of a main stem.

In the illustrated embodiment of the invention, the stem portions 13*a* and 13*b* are formed to reach approximately the same height so that, when the floral organs represented by elements 15,16 and 17 are installed in receptacles 14, a so-called umbel is simulated. Of course, the stem-defining members 12A and 12B can be given other configurations for simulating other natural plant formations. In any case, the engagement of the bifurcated projections 21 on the collar of one of the stem-defining members with stem portions of another of such members ensures that the desired angular relationships of the stem portions will be maintained even when the artificial plants are packed for shipment or storage or are otherwise subjected to forces that would tend to orient the various stem portions in a single plane.

Although only the stem-defining member 12B is shown to have the bifurcated projections 21 thereon, it will be appreciated that, in accordance with this invention, all of the stem-defining members 12A and 12B may be formed with such bifurcated projections. Further, if desired, the collar 20*b* may be formed with only a bifurcated projection 21 rather than the illustrated diametrically opposed bifurcated projections.

Having described a preferred embodiment of the invention with reference to the accompanying drawings and certain modifications thereof, it is to be understood that the invention is not limited to that precise embodiment and the specifically described modifications, and that various changes and other modifications may be effected therein by one skilled in the art without departing from the scope or spirit of the invention as defined in the appended claims.

What is claimed is:

1. An artificial representation of a plant comprising a main stem having an apex portion at an end thereof, and a plurality of stem-defining members each molded of plastic and including a collar and a plurality of stem portions arising from said collar and being arranged substantially coplanar with each other, at least one of said stem-defining members further having at least one bifurcated projection extending from said collar of said one stem-defining member and embracing a stem portion of another of said stem-defining members when the collars of said stem-defining members are disposed one above the other on said apex portion of the main stem, to hold said stem-defining members against turning relative to each other about said apex portion of the main stem, each said bifurcated projection being arranged on the respective collar to maintain the stem portions of said one stem-defining member in a plane angularly displaced from the plane of the stem portions of each other of said stem-defining members.

2. An artificial representation of a plant according to claim 1; in which said stem portions terminate in receptacles, and further comprising elements representing floral organs engaged in said receptacles to form an umbel.

3. An artificial representation of a plant according to claim 2; in which said elements representing floral organs include fabric elements simulating petals and each having a central hole, and a plastic headed pin simulating a pistil and being insertable through said central hole of the respective fabric element into the respective receptacle.

4. An artificial representation of a plant according to claim 1; in which said at least one stem-defining member has a second bifurcated projection extending from said collar thereof in opposition to said one bifurcated projection and also embracing a stem portion of said other stem-defining member.

* * * * *